US005437435A

United States Patent [19]

Dötsch et al.

[11] Patent Number: 5,437,435

[45] Date of Patent: Aug. 1, 1995

[54] GAS PURGING DEVICE

[75] Inventors: Lorenz Dötsch, Vallendar; Karl-Heinz Höfer, Urmitz; Helmut Preyer, Kurtscheid, all of Germany

[73] Assignee: Radex-Heraklith Industriebeteiligungs Aktiengesellschaft, Wein, Austria

[21] Appl. No.: 117,489

[22] Filed: Sep. 7, 1993

Related U.S. Application Data

[63] Continuation of Ser. No. 749,266, Aug. 23, 1991, abandoned.

[30] Foreign Application Priority Data

Aug. 25, 1990 [DE] Germany ..... 420 26 779.9

[51] Int. Cl.[6] ..... C21C 5/48

[52] U.S. Cl. ..... 266/220; 266/265

[58] Field of Search ..... 266/220, 265

[56] References Cited

U.S. PATENT DOCUMENTS 4,687,184 8/1987 Labate et al. ..... 266/265

FOREIGN PATENT DOCUMENTS 3901926 12/1989 Germany ..... 266/265

2096290 10/1982 United Kingdom ..... 266/265

*Primary Examiner*—Melvyn J. Andrews

*Attorney, Agent, or Firm*—John F. A. Earley; John F. A. Earley, III

[57] ABSTRACT

The present invention pertains to a gas purging device for introducing gases and/or solid reactants into the metal melt of a metallurgical crucible, consisting of a gas purging plug, a well nozzle sleeve surrounding it, and/or a well nozzle surrounding the plug or the nozzle brick, with a mounting device arranged in the area of the respective end face.

21 Claims, 2 Drawing Sheets

GAS PURGING DEVICE

This is a continuation of application Ser. No. 07/749,226 filed on Aug. 23, 1991 now abandoned.

The present invention pertains to a gas purging device for introducing gases and/or solid reactants into the metal melt of a metallurgical crucible, consisting of a gas purging plug, a well nozzle sleeve surrounding same, and/or a well nozzle surrounding the gas purging plug or the well nozzle sleeve.

Such gas purging devices have been known for a long time. As is shown by *Radex-Rundschau* 1987, p. 288, the plug is either placed directly into a well nozzle, or a well nozzle sleeve is inserted between the well nozzle and the plug. For installation, the parts are inserted into the bottom or the wall of a metallurgical crucible one after another, and then joined together with mortar.

The installation causes rather considerable difficulties, especially because some of the individual parts of the plug device are very heavy.

Mounting brackets via which the purging plug can be lifted into the corresponding opening of the well nozzle have been known from, e.g., West German Utility Model 87 00 094 or West German Patent 35 20 783. In both cases, the prior-art mounting brackets presuppose that the plug is surrounded with a sheet metal jacket. However, this is not always so. While the mounting bracket according to DE-GM 87 00 094 can have only a relatively small opening, because it is punched out of the sheet metal jacket, the mounting bracket according to DE-PS 35 20 783 has the disadvantage that the outer circumferential width of the metal jacket is expanded, as a result of which problems arise when inserting the plug in the corresponding well nozzle, because the corresponding opening width is only slightly larger than the diameter of the corresponding gas plug at its top end.

The basic object of the present invention is to show a possibility on how gas purging devices of the type described in the introduction can be placed into the bottom or the wall of a metallurgical crucible while avoiding the above-described disadvantages.

To accomplish this object, the present invention is based on the general consideration that necessary mounting devices are arranged directly in the ceramic material of the component or components of the device, namely, in the area of the end face facing the metal melt.

Thus, in its most general embodiment, the present invention discloses a 9as purging device of the type described which is characterized in that at least one mounting device for detachable connection to a lifting device is inserted into the end face facing the metal melt, of the gas purging plug, of the well nozzle sleeve and/or of the well nozzle brick.

"And/or" means that each of the parts of the gas purging device may be designed correspondingly; however, especially in the case of a joint prefabrication, which will be explained below in greater detail, it is, of course, also sufficient to correspondingly design only one component, preferably the well nozzle.

The "mounting device" may have different designs. It may comprise a hook or the like anchored in the ceramic; however, it may also be designed detachably, wherein, e.g., a receiving part is fixed in the matrix material of the ceramic body, while a corresponding hook or the like can be detachably inserted into this receiving part. However, it may also consist of one depression or a plurality of depressions, into which a lifting tool is directly or indirectly inserted. In this case, it would also be possible to arrange the connecting elements on the side if sufficient space is available there on installation.

In the simplest case, a hook, a hoop, a bracket, or the like is cast in the upper part (facing the metal melt) of the component; this is done, of course, such that it satisfies the characteristic of claim 1, namely, that such means may be detachably connected to a lifting device.

The anchoring between the ceramic and the mounting device is also improved by a threaded section, a device like an expanding anchor, or the like.

However, it is also possible to provide in the end face of the component, a bead-like depression which is molded, e.g., during pressing or casting in situ. This depression may also have, e.g., ceramic internal threads; however, it is also possible to bond in, on the wall side, a metal collar provided with such threads or to embed it in mortar. The anchoring part, the hook or the like, which will have corresponding external threads in this case, may now be inserted into the corresponding receiving part stationarily, but detachably.

Instead of corresponding threaded sections, the bead-like depression or the anchoring element may also be designed with a corresponding pin/slot connection, similar to a bayonet catch.

According to an alternative embodiment of the present invention, the corresponding receiving parts are embedded in mortar or bonded as prefabricated parts in corresponding bead-like depressions after manufacturing the ceramic body.

The essential advantage of all embodiments over mounting brackets as described in the state of the art is that it is possible to handle the gas purging plug well as the well nozzle sleeve and the well nozzle individually or together, regardless of whether or not these are jacketed with sheet metal. In all cases, a hook or the like, which may be designed with any desired opening width, projects from the end face of the corresponding component, so that no problems will arise in terms of arrangement on the corresponding gear of a lifting device or the like.

If a prefabricated unit consisting of gas purging plug and well nozzle, or gas purging plug, well nozzle sleeve, and well nozzle is provided, it is sufficient to provide corresponding mounting devices on one of the components, preferably in the end face of the well nozzle brick. By these (mounting devices), the entire unit can be lifted together and inserted into the wall or the bottom of the metallurgical crucible.

In this case, an advantageous embodiment of the present invention provides for the arrangement of at least three mounting devices spaced at approximately equal angular distances from one another in the area of the end face of the well nozzle. If the mounting devices consist of, e.g., the above-mentioned hooks, they may be hung into a corresponding gear of a lifting device, and the entire device can then be fitted in.

If the mounting device is designed as a detachable device, as described above, the corresponding manipulating means can subsequently be removed and reused.

If the mounting device is provided in the gas plug itself, one such device is, of course, sufficient, and it is preferably provided in the extension of the central longitudinal axis of the plug in its end face.

Further characteristics of the present invention will become apparent from the characteristics of the subclaims as well as the other application documents.

The present invention will be explained below in greater detail on the basis of three embodiments. Here, in highly schematic representations, FIG. 1 shows a gas purging plug with a mounting device associated with a well nozzle, FIG. 2 shows a prefabricated gas purging device consisting of a gas purging plug, which is embedded in mortar in a well nozzle, wherein the well nozzle has three mounting devices, and FIG. 3 shows a gas purging device in which a well nozzle sleeve is arranged in a well nozzle, and a gas purging plug is arranged in this well nozzle sleeve, with mounting devices in the area of the well nozzle.

Identical or functionally identical components are designated by identical reference numerals in the figures.

Figure 1:
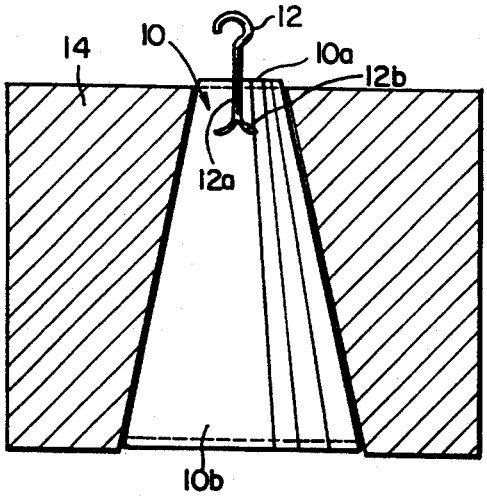

In all embodiments, the gas purging plug 10 shown is a plug with directed porosity. Said plug 10 according to FIG. 1 is a cast plug. During casting, a hook 12 was cast in. In the area of the upper end face 10*a*, and the lower section 12*a* (of said hook 12) is thus located in the ceramic matrix material 10*b* of the plug and is designed similarly to an expanding anchor at 12*b* at its end in this area, so that it is firmly lodged in the ceramic material 10*b*.

Said hook 12 extends above said end face 10*a*. Via a gear (not shown) of a lifting device, said plug 10 is able to be grasped by said hook 12 and inserted into the corresponding well nozzle 14, and said plug 10 and well nozzle 14 are joined together with mortar along their corresponding surfaces in the known manner.

It is assumed in the embodiment according to FIG. 1 that said well nozzle 14 is already positioned in the bottom or the wall of the metallurgical crucible.

Figure 2:
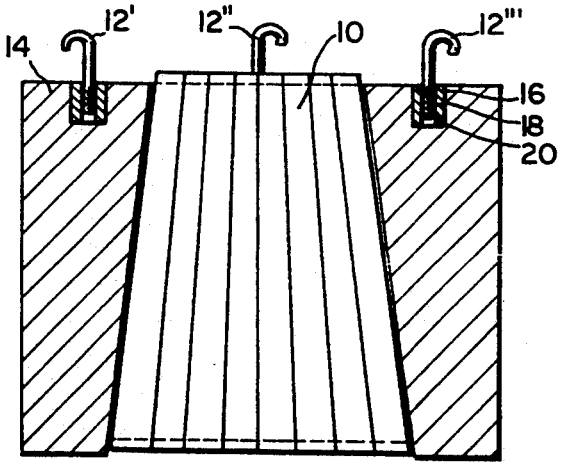

The embodiment according to FIG. 2 differs from that shown in FIG. 1 in that said well nozzle 14 and said plug 10 were prefabricated outside the metallurgical crucible, i.e., they were joined together with mortar. Said mounting device (hook) 12 is not arranged in said plug 10 here, but three hooks 12', 12'', and 12'– are arranged in the end face 14*a* of said well nozzle 14. Unlike said hook 12 in said plug 10 according to FIG. 1, they are not cast into the matrix material of said well nozzle 14. Instead, three bead-like depressions 16, in which sleeve-shaped inserts 18 with internal threads 20 were subsequently embedded by a mortar were provided in the area of said end face 14*a* at the time of manufacture of said well nozzle 14. Said internal threads 20 are always provided within a metal collar which is bonded into said sleeve-shaped inserts 18.

As shown in FIG. 2, said hooks 12 have corresponding external threads at their lower ends 12*a* in this case, and they are thus fixed relative to said internal threads 20.

The three mounting devices are arranged at angles of 120° each relative to one another, so that uniform load distribution is achieved when the unit consisting of said well nozzle 14 and the said integrated plug 10 is fastenend to the gear of a lifting device (not shown) and positioned in the wall or the bottom of the metallurgical crucible and embedded in mortar there.

Figure 3:
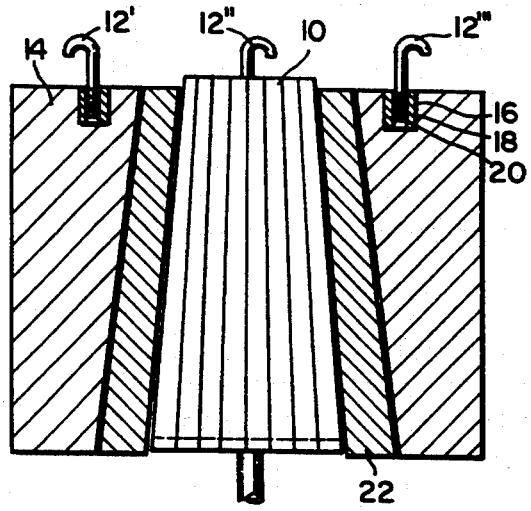
Figure 6:
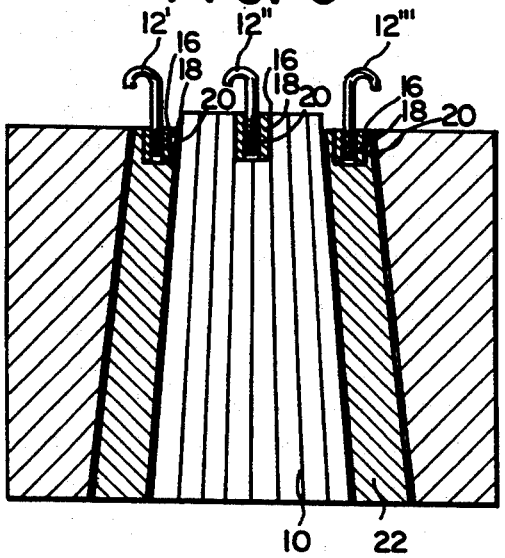
FIG. 6 shows a gas purging device in which a well nozzle sleeve is arranged in a well nozzle, and a gas purging plug is arranged in this well nozzle sleeve, with mounting devices disposed in the well nozzle sleeve and in the gas purging plug.

The embodiment according to FIG. 3 corresponds extensively to that according to FIG. 2, the difference being that a well nozzle sleeve 22 is arranged between said well nozzle 14 and said plug 10, and said components 10, 14, and 22 are again joined together by mortar along their corresponding surfaces.

Consequently , a prefabricated unit as a whole is installed via the mounting devices in this case as well.

Since the mounting devices are always arranged in the area of the upper end face of the corresponding components, which face faces the metal melt, no problems arise on installation because of laterally projecting mounting parts, as happens in the device according to DE-PS 35 20 783.

Due to the possibility of arranging a plurality of mounting devices, it is also possible to bring heavy parts, especially prefabricated gas purging devices, accurately to the desired position and install them there without any problems.

Other embodiments are possible within the framework of the suggestion according to the present invention. For example, it is obviously possible to replace the open hook 12 shown with a closed bracket, both ends of which are embedded, e.g., in the ceramic matrix material. Said straddling dowel-like sections 12*b* may also be replaced with other thickenings in the area of said hook 12 in order to fix this securely in the ceramic.

Figure 4:
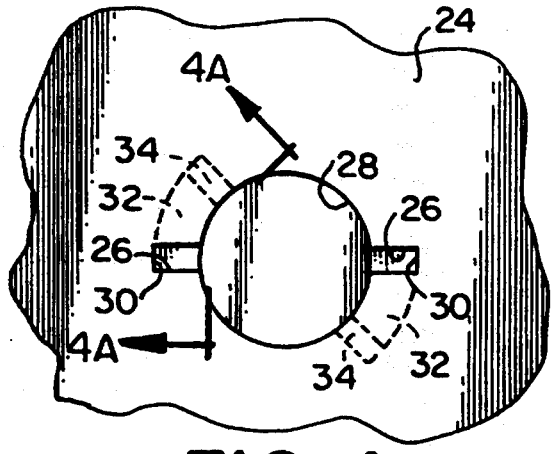
FIG. 4 shows a hole structure having peripheral slots.
Figure 4A:
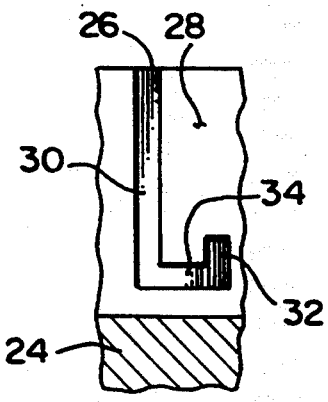
FIG. 4A is a sectional view of the hole structure shown in FIG. 4, taken along the lines and arrows 4A—4A.
Figure 5:
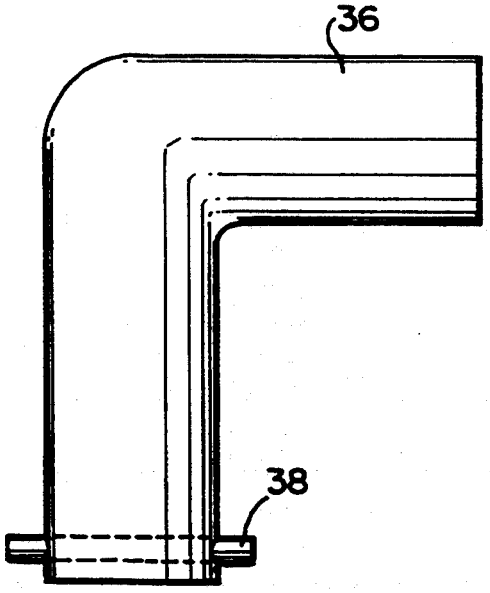
FIG. 5 shows one embodiment of a hook used with the hole structure of FIG. 4.

For example, turning to FIGS. 4 and 4A and 5 there is shown a gas purging device characterized in that hole 24 are provided with at least two peripheral slots 26 each. Each slot 26 has a portion 30 which extends vertically downward from upper end face 28 of the gas purging device and has a portion 32 which extends approximately parallel to the end face 28 at a spaced location from it before it is joined by another small slot portion 34 directed in the direction of the end face 28.

As shown in FIG. 5, corresponding hook or the like 36 has, on its corresponding circumferential surface, corresponding, radially projecting pins 38. The pins 38 are intended to be inserted into the slots 26 of the hole 24.

We claim:

1. Gas purging device for introducing gases and/or solid reactants into the metal melt of a metallurgical crucible, comprising a gas purging plug (10), and a nozzle sleeve (22) surrounding the plug (10), or a gas purging plug (10) and a well nozzle (14) surrounding the plug (10), or a gas purging plug (10), a nozzle sleeve (22) surrounding the plug of (10), and a well nozzle (14) surrounding the nozzle sleeve (22), and at least one mounting device which comprises a hole (16) provided in an upper end face of the plug (10), of the nozzle sleeve (22) or of the well nozzle (14) into which (a) corresponding hook(s) (12) or loops can be stationarily but detachably inserted.

2. Gas purging device in accordance with claim 1, wherein the gas purging plug comprises a ceramic matrix material (10*b*) and wherein the mounting device(s) is (are) cast into the ceramic material (10*b*).

3. Gas purging device in accordance with claim 1, wherein the holes (16) are provided with inserts (20)

having internal threads (20), and the corresponding hooks (12) or loops are provided with corresponding external threads.

4. Gas purging device in accordance with claim 3, wherein the holes (16) or the inserts (18) provided in said holes have a metallic receiving part for the corresponding hook (12) or loop.

5. Gas purging device in accordance with claim 1, wherein the holes (16) are provided with at least two peripheral slots each, wherein each slot first extends vertically downward from the upper end face and extends approximately parallel to the end face at a spaced location from it before it is joined by another small slot section directed in the direction of the end face, and the corresponding hook or loop has, on its corresponding circumferential surface, corresponding, radially projecting pins intended to be inserted into the slots of the hole (16).

6. Gas purging device in accordance with claim 1, wherein at least three mounting devices are arranged at approximately equal angular distances from one another in the area of the end face of the nozzle sleeve (22) or the well nozzle (14).

7. Gas purging device in accordance with claim 1, wherein the mounting device(s) comprises (comprise) of prefabricated components (18, 20), which are inserted into corresponding holes (16) in the area of the end face of the plug (10), of the nozzle sleeve (22), or of the well nozzle (14), and is (are) fixed there by means of putty.

8. Gas purging device for introducing gases and/or solid reactants into the metal melt of a metallurgical crucible, comprising a gas purging plug (10), and a nozzle sleeve (22) surrounding the plug (10), or a gas purging plug (10) and a well nozzle (14) surrounding the plug (10), or a gas purging plug (10), a nozzle sleeve (22) surrounding the plug (10), and a well nozzle (14) surrounding the nozzle sleeve (22), and at least one mounting device which comprises a hole (16) provided in an upper end face of the plug (10), of the nozzle sleeve (22) or of the well nozzle (14) into which (a) corresponding hook(s) (12) or loops can be stationarily but detachably inserted, wherein the gas purging plug comprises a ceramic matrix material (10*b*) and wherein the mounting device(s) is (are) cast into the ceramic material (10*b*), wherein the holes (16) are provided with inserts (18) having internal threads (20), and the corresponding hooks (12) or loops are provided with corresponding external threads, wherein the holes (16) or the inserts (18) provided in said holes have a metallic receiving part for the corresponding hook (12) or loop, wherein at least three mounting devices are arranged at approximately equal angular distances from one another in the area of the end face of the nozzle sleeve (22) or the well nozzle (14), and wherein the mounting devices comprise prefabricated components (18, 20), which are inserted into corresponding holes (16) in the area of the end face of the plug (10), of the nozzle sleeve (22), or of the well nozzle (14), and are fixed there by means of putty.

9. Gas purging device for introducing gases, solid reactants, or gases and solid reactants into a metal melt of a metallurgical crucible, comprising a gas purging plug having an upper end face, a well nozzle surrounding the gas purging plug, the well nozzle having an upper end face, engagement means for releasably engaging a lifting device, and connecting-disconnecting means for releasably holding the engagement means to the upper end face of the gas purging plug or the upper end face of the well nozzle so that the gas purging device may be lifted by a lifting device via the engagement means and for releasing the engagement means from the upper end face of the gas purging plug or the upper end face of the well nozzle for later re-use, the connecting-disconnecting means comprising a hole formed in the upper end face of the gas purging plug or in the upper end face of the well nozzle, and the engagement means including (a) corresponding hook(s) or loops which can be stationarily but detachably inserted into the hole(s) of the connecting-disconnecting means.

10. The gas purging device of claim 9, the connecting-disconnecting means further comprising, internal threads formed in the hole, and external threads formed on said engagement means adapted to engage the internal threads formed in the hole to secure the engagement means to the upper end face of the gas purging plug or the well nozzle.

11. Gas purging device of claim 9, the hole being cast into the gas purging plug or the well nozzle.

12. Gas purging device in accordance with claim 9, wherein the holes are provided with at least two peripheral slots each, wherein each slot first extends vertically downward from the upper end face and extends approximately parallel to the end face at a spaced location from it before it is joined by another small slot section directed in the direction of the end face, and the corresponding hook or loop has, on its corresponding circumferential surface, corresponding, radially projecting pins intended to be inserted into the slots of the hole.

13. Gas purging device in accordance with claim 9, wherein at least three engagement means are arranged at approximately equal angular distances from one another in the area of the end face of the well nozzle.

14. Gas purging device in accordance with claim 9, wherein the engagement means comprises (comprise) of prefabricated components, which are inserted into corresponding holes in the area of the end face of the plug, or of the well nozzle, and is (are) fixed there by means of putty.

15. Gas purging device for introducing gases, solid reactants, or gases and solid reactants into a metal melt of a metallurgical crucible, comprising a gas purging plug having an upper end face, a well nozzle surrounding the gas purging plug, the well nozzle having an upper end face, engagement means for releasably engaging a lifting device, and connecting-disconnecting means for releasably holding the engagement means to the upper end face of the gas purging plug or the upper end face of the well nozzle so that the gas purging device may be lifted by a lifting device via the engagement means and for releasing the engagement means from the upper end face of the gas purging plug or the upper end face of the well nozzle for later re-use, the connecting-disconnecting means comprising a hole formed in the upper end face of the gas purging plug or in the upper end face of the well nozzle, and the engagement means including (a) corresponding hook(s) or loops which can be stationarily but detachably inserted into the hole(s) of the connecting-disconnecting means, the connecting-disconnecting means further comprising internal threads formed in the hole, and external threads formed on the hook or loop of said engagement means adapted to engage the internal threads formed in the hole to secure the engagement means to the upper end face of the gas purging plug or the well nozzle, the hole being cast into the gas purging plug or the well nozzle, wherein at least three engagement means are arranged at approximately equal angular distances from one another in the area of the end face of the well nozzle, and wherein the engagement means comprise prefabricated components, which are inserted into corresponding holes in the area of the end face of the plug, or of the well nozzle, and are fixed there by means of putty.

16. Gas purging device for introducing gases, solid reactants, or gases and solid reactants into a metal melt of a metallurgical crucible, comprising a gas purging plug having an upper end face, a well nozzle surrounding the gas purging plug, the well nozzle having an upper end face, a nozzle sleeve positioned between the gas purging plug and the well nozzle, the well nozzle sleeve having an upper end face, engagement means for releasably engaging a lifting device, and connecting-disconnecting means for releasably holding the engagement means to the upper end face of the gas purging plug, or the upper end face of the well nozzle, or the upper end face of the well nozzle sleeve so that the gas purging device may be lifted by a lifting device via the engagement means and for releasing the engagement means from the upper end face of the gas purging plug, or the upper end face of the well nozzle, or the upper end face of the well nozzle sleeve for later re-use, the connecting-disconnecting means comprising a hole formed in the upper end face of the gas purging plug, or in the upper end face of the well nozzle, or in the upper end face of the nozzle sleeve, and the engagement means including (a) corresponding hook(s) or loops which can be stationarily but detachably inserted into the hole(s) of the connecting-disconnecting means.

17. The gas purging device of claim 16, the connecting-disconnecting means further comprising internal threads formed in the hole, and external threads formed on the hook or loop of said engagement means adapted to engage the internal threads formed in the hole to secure the engagement means to the upper end face of the gas purging plug, the well nozzle, or the nozzle sleeve.

18. Gas purging device of claim 16, the hole being cast into the gas purging plug or the well nozzle, or the nozzle sleeve.

19. Gas purging device in accordance with claim 16, wherein the holes are provided with at least two peripheral slots each, wherein each slot first extends vertically downward from the upper end face and extends approximately parallel to the end face at a spaced location from it before it is joined by another small slot section directed in the direction of the end face, and the corresponding hook or loop has, on its corresponding circumferential surface, corresponding, radially projecting pins intended to be inserted into the slots of the hole.

20. Gas purging device in accordance with claim 16, wherein at least three engagement means are arranged at approximately equal angular distances from one another in the area of the end face of the well nozzle or the nozzle sleeve.

21. Gas purging device in accordance with claim 16, wherein the engagement means comprises (comprise) of prefabricated components, which are inserted into corresponding holes in the area of the end face of the plug, of the nozzle sleeve, or of the well nozzle, and is (are) fixed there by means of putty.

* * * * *